US007140850B2

(12) United States Patent
Otis, Jr.

(10) Patent No.: US 7,140,850 B2
(45) Date of Patent: Nov. 28, 2006

(54) PERISTALTIC PUMP WITH ROLLER PINCH VALVE CONTROL

(75) Inventor: David R. Otis, Jr., Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 549 days.

(21) Appl. No.: 10/627,459

(22) Filed: Jul. 25, 2003

(65) Prior Publication Data

US 2005/0019185 A1 Jan. 27, 2005

(51) Int. Cl.
*F04B 43/12* (2006.01)

(52) U.S. Cl. ..... 417/477.1

(58) Field of Classification Search ..... 417/43, 417/214, 223, 477.1; 74/813 L
See application file for complete search history.

(56) References Cited

U.S. PATENT DOCUMENTS 3,799,702 A * 3/1974 Weishaar ..... 417/38
4,600,366 A * 7/1986 Stenner ..... 417/319
5,133,440 A * 7/1992 Lang et al. ..... 192/139

* cited by examiner

*Primary Examiner*—Anthony D. Stashick
*Assistant Examiner*—Samuel E. Belt

(57) ABSTRACT

A pump having a rotary portion which compels the movement of a fluid by peristaltic compression of resilient tubing containing the fluid includes a roller assembly having at least one roller mounted in the rotary portion of the pump for contact with the resilient tubing. The roller has a range of rotation in contact with the tubing during pump operation. A roller control mechanism is adapted and constructed to stop the roller at a single, predetermined location on the tubing when the pump operation is stopped.

20 Claims, 3 Drawing Sheets

PERISTALTIC PUMP WITH ROLLER PINCH VALVE CONTROL

FIELD OF THE INVENTION

The invention relates generally to the use of rollers for flow control in peristaltic pumps.

BACKGROUND OF THE INVENTION

Peristaltic pumps are used in a variety of applications in which it is desirable to convey fluid in accurately controllable quantities. Peristaltic pumps typically include a rotary portion which compels the movement of a fluid by peristaltic compression of resilient tubing containing the fluid against an arcuate rigid surface known as a pump occlusion. The roller/occlusion intersection area is typically known as the "working area" of the pump.

Imaging systems using inkjet printing have become widely known, and are often implemented using thermal inkjet technology. Such technology forms characters and images on a medium, such as paper, by expelling droplets of ink in a controlled fashion so that the droplets land on the medium. The printer, itself, can be conceptualized as a mechanism for moving and placing the medium in a position such that the ink droplets can be placed on the medium, a printing cartridge which controls the flow of ink and expels droplets of ink to the medium, and appropriate hardware and software to position the medium and expel droplets so that a desired graphic is formed on the medium. A conventional print cartridge for an inkjet type printer comprises an ink containment device and an ink-expelling apparatus, commonly known as a printhead, which heats and expels ink droplets in a controlled fashion.

In some inkjet type printers, a peristaltic pump head is used to drive multiple, resilient tubes to convey ink between the containment device and the printhead. In some pump applications, flow control is achieved simply by turning the pump off. In applications requiring more precise flow control, a valve mechanism is typically provided downstream of the pump outlet to selectively permit or prevent the flow of ink from the pump.

Whether or not a separate control valve is provided, the rollers of the peristaltic pump stop at random positions. During repeated starting and stopping of pump operation, the rollers will have stopped at positions along the entire arc of the roller/occlusion intersection, causing repeated flattening and permanent deformation of the flow area of the peristaltic tubes in the working area of the pump. Over the life of the pump, tube deformation can become so severe that it significantly alters the volumetric flow rate for a given pump motor RPM.

There are two principal remedies for severe peristaltic tube deformation. The most common solution is tube replacement, which requires removal, disassembly, repair, and replacement of the entire pump. One alternative to tube replacement is the provision of a mechanism to pull open the flattened tube. Unfortunately, pulling mechanisms are relatively complex and expensive.

It can be seen from the foregoing that the need exists for a simple, inexpensive, arrangement for reducing the effect of tube flattening in peristaltic pumps.

SUMMARY OF THE INVENTION

The present invention is directed to a pump having a rotary portion which compels the movement of a fluid by peristaltic compression of resilient tubing containing the fluid includes a roller assembly having at least one roller mounted in the rotary portion of the pump for contact with the resilient tubing. The roller has a range of rotation in contact with the tubing during pump operation. A roller control mechanism is adapted and constructed to stop the roller at a single, predetermined location on the tubing when the pump operation is stopped.

DETAILED DESCRIPTION OF THE INVENTION

Figure 1:
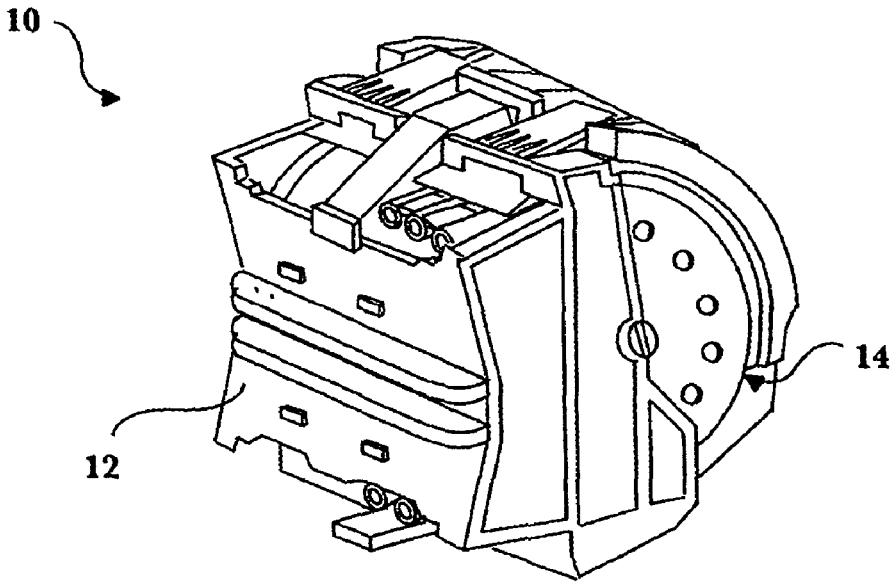
FIG. 1 is a schematic perspective view of an exemplary embodiment of a pump assembly in accordance with the principles of the present invention.

An exemplary embodiment of a peristaltic pump assembly 10 in accordance with the principles of the present invention is shown in FIG. 1. The pump assembly 10 is provided with an outer housing 12 enclosing a working portion 14. The housing 12 serves to protect the working portion 14 from its surroundings, and can also be configured to adapt the pump assembly 10 for fitting into the device in which it is installed. The pump assembly 10, as illustrated, is adapted and constructed to be employed in an imaging system, such as the ink supply system of an electronic printer. It is contemplated that the principles of the present invention are also applicable to any other system in which peristaltic pump having multiple flexible tubes is used.

Figure 2:
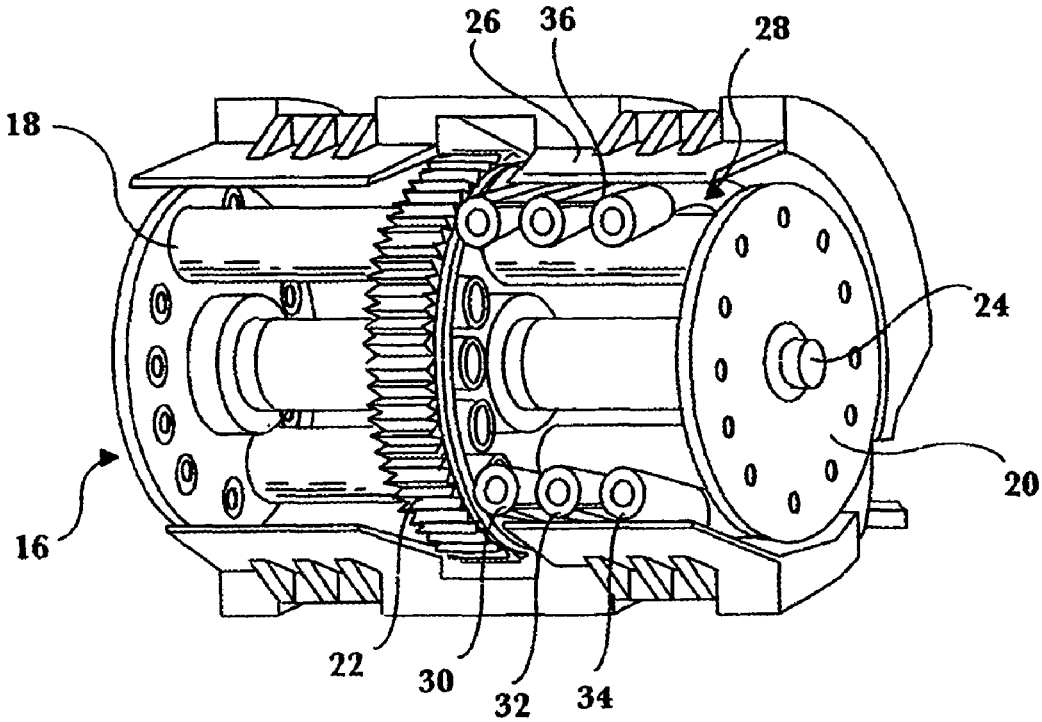
FIG. 2 is a schematic sectional view of a roller assembly of the FIG. 1 embodiment in various rotational positions.

As shown in FIG. 2, the working portion 14 of the pump assembly 10 includes a rotor 16 having at least one roller, here provided as a pair of rollers 18, 20. The rollers 18, 20 are driven in a known manner for rotation about an axis 22.

A pump occlusion 24 partially surrounds the rotor 16. A tube component 26 is secured between the pump occlusion 24 and the rotor 16. The tube component 28 includes at least one flexible tube 30. The pump occlusion 24 is radially spaced from the rollers 18, 20, and provides a working surface such that rotation of the rotor 16 in the direction of the arrow A causes the rollers 18 to compress and collapse the tube 30 against the occlusion 24 to impart motive force to fluid contained within the tubes 30 in a known manner.

During operation of the pump assembly 10, the rollers rotate until the desired quantity of fluid has been conveyed, whereupon rotation of the rotors 18, 20 is stopped. In conventional pump assemblies, the stopping position of the rollers is random, as shown at illustrative positions P1 and P2 of FIG. 2.

Figure 3:
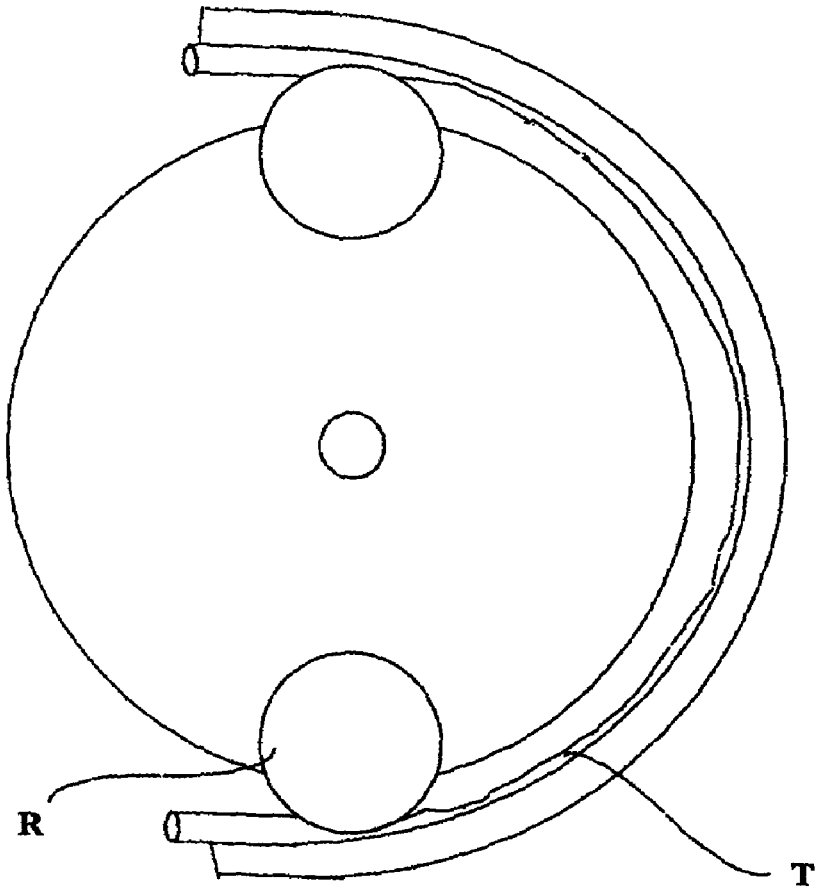
FIG. 3 Background Art
FIG. 3 is a schematic detailed sectional view of a conventional roller in contact with resilient tubing in the working area of the pump.

As shown in FIG. 3, repeated random stopping of a roller R at various locations on the tube T over the life of the pump can cause the tube T to be severely and permanently crushed, thus adversely affecting pump flow rates for given pump RPM's. For example, if compression set of the tube T results in a flow cross-section that is 20% less than an uncompressed tube, the amount of flow (dictated by the amount of fluid between rollers) will be reduced by 20%.

Figure 4:
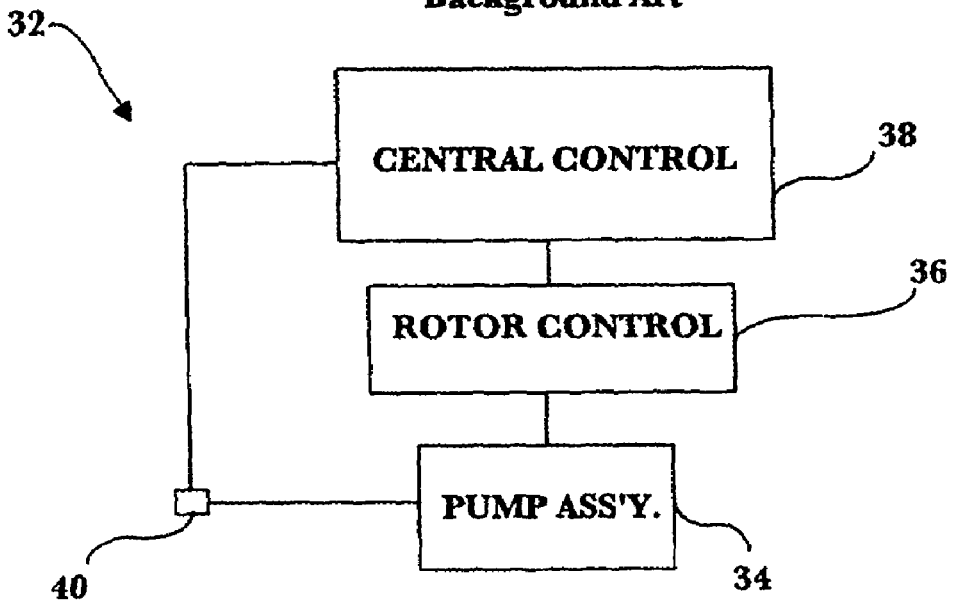
FIG. 4 is a schematic of an exemplary embodiment of a pump control system.

A pump control schematic 32 in accordance with the principle of the present invention is shown in FIG. 4. A pump assembly 34 is connected with a rotor control mechanism 36, which can be provided as a slip clutch or other suitable control mechanism. The rotor control mechanism is operated by a central control 38, which can be the control processor of the device, such as a printer, with which the pump assembly 34 is associated. The central control 38 can be used to cause the rotor of the pump assembly 34 to stop at a single, predetermined location on the tubing when the pump operation is stopped. For example, the rotor can be stopped so that one or the other of the rollers 18 is in a bottom position, as shown in solid line in FIG. 2. A consistent stop position will localize any deformation of the pump tubing, thus minimizing the effect on flow rates. If desired, one or more flow sensors 40 can be connected to the downstream end of the pump assembly 34 to provide the central control 38 with information relating to actual flow rates produced by the pump assembly 34. This will allow the central control 38 to compensate for any reduction in flow rates caused by localized tube deformation.

Figure 5:
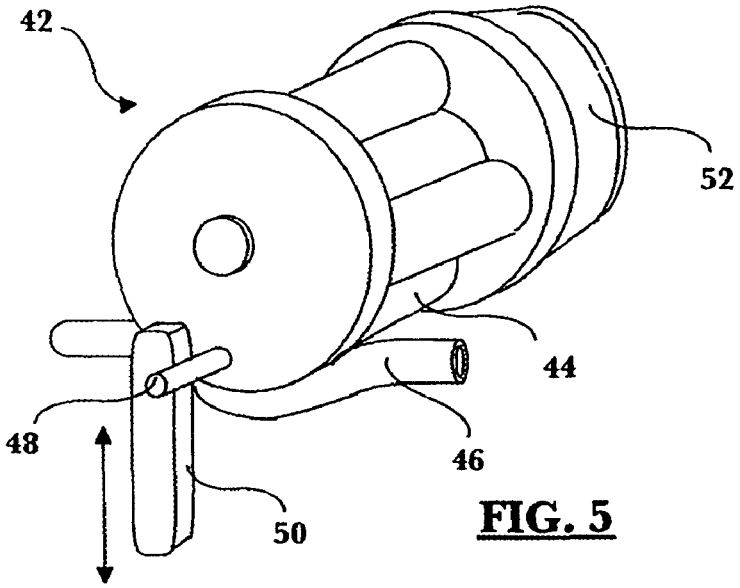
FIG. 5 is a schematic perspective view of an exemplary embodiment of a pump rotor assembly in accordance with the principles of the present invention.

As shown in FIG. 5, an exemplary embodiment of a rotor assembly 42 includes a plurality of rollers 44 adapted to pump fluid through a peristaltic tube 46. A stop-pin 48 is mounted on the rotor assembly 42 for rotation with the rollers 44. It is contemplated that the stop-pin will be located in axial alignment with one of the rollers 44 to define the stop position of the rotor assembly 42. A stop bar 50 is vertically movable to a first position engaging the stop pin 48 when the rotor assembly 42 is to be stopped, and a second position disengaged from the stop pin 48 when the rotor assembly 42 is rotating during pump operation. The stop bar 50 can be operated by any suitable mechanism, such as a solenoid, and can be controlled, for example, by the central controller of the mechanism with which the pump rotor assembly is associated.

Figure 6:
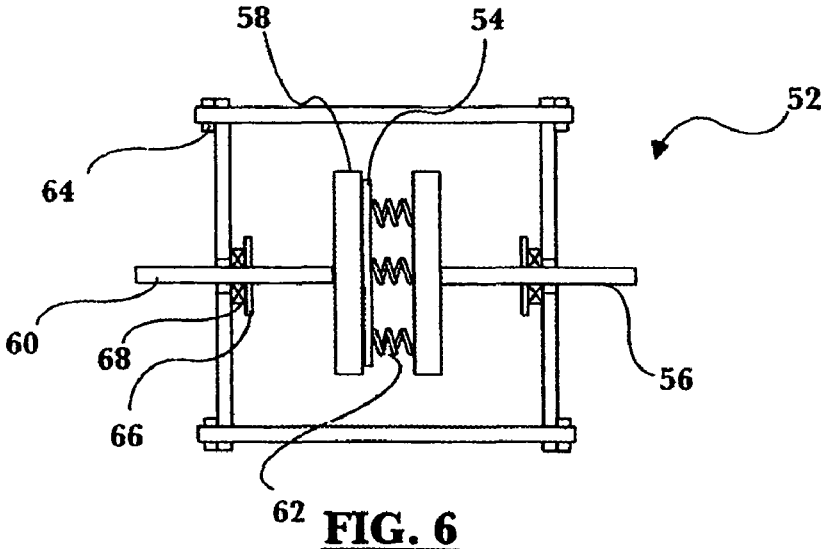
FIG. 6 is a schematic sectional view of an exemplary embodiment of a slip clutch in accordance with the FIG. 5 embodiment.

A slip clutch 52 is provided to drive the rotor assembly 42. Slip clutches, i.e., friction clutches that will interrupt transmission of power when input torque exceeds a certain limit, are known per se. A schematic operational diagram of the slip clutch 52 is shown in FIG. 6. The slip clutch 52 includes a clutch element 54 on an input drive shaft 56. A slip surface 58 is mounted for contact with the clutch element 54 on an output shaft 60. The clutch element 54 is urged into contact with the slip surface 58 by a plurality of compression springs 62. Torque limiting adjusters 64are provided to selectively set the torque limit of the slip clutch, and the drive shafts are mounted via snap rings 66 adjacent to bearings 68.

Figure 7:
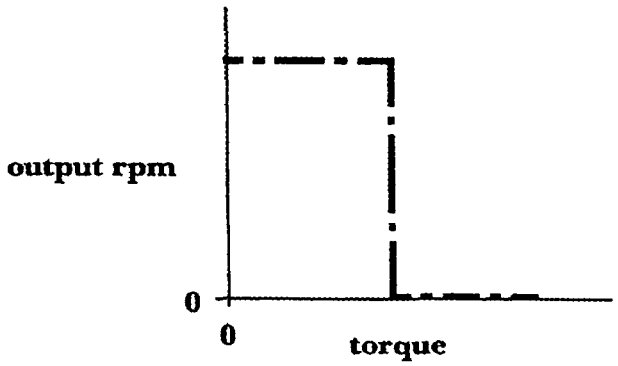
FIG. 7 is a schematic graphic representation of slip-clutch performance.

In operation, as the input side of the shaft 56 is rotated by a motor or other power mechanism (not shown), the torque is transferred from the input shaft 56 to the output shaft 60 as long as the clutch element 54 remains engaged with the slip surface 58. If torque on the input shaft 56 exceeds a predetermined limit, the clutch element 54 will rotate against the slip surface 58, thus limiting the amount of torque transferred to the output shaft 60. This results in a plot of output rpm vs. input torque as shown in FIG. 7.

Having the rollers stop in a repeatable position keeps the major portion of the working section of the peristaltic tube from ever being flattened by compression set. This greatly reduces the impact of tube compression set on volumetric flow rates for given pump RPM's, thus yielding more consistent and predictable pump operation. The stoppage of the roller in a consistent position can further serve as a pinch valve for isolating the upstream and downstream sections of the tube. This is advantageous in applications where pumping is intermittent, and there is a need to prevent flow through the tube when the pump is off.

Although the present invention has been described with reference to specific embodiments, those of skill in the art will recognize that changes may be made thereto without departing from the scope and spirit of the invention as defined by the appended claims.

What is claimed is:

1. In a pump having a rotary portion which compels the movement of a fluid by peristaltic compression of resilient tubing containing the fluid, a roller assembly comprising the following:

a rotor having at least one roller mounted in the rotary portion of the pump for contact with the resilient tubing, the at least one roller having a range of rotation in contact with the tubing during pump operation; and a rotor control mechanism adapted and constructed to stop the rotor such that the at least one roller is stopped at a single, predetermined location on the tubing when the pump operation is stopped.

2. A roller assembly in accordance with claim 1, wherein the at least one roller comprises two rollers.

3. A roller assembly in accordance with claim 2, wherein the rollers are spaced apart circumferentially such that the rollers trap a consistent quantity of fluid between them during operation of the pump.

4. A roller assembly in accordance with claim 2, wherein the rotor control mechanism is adapted and constructed to cause one of the rollers to stop at a bottom position thereof.

5. A roller assembly in accordance with claim 4, wherein the rotor control mechanism comprises a stop-pin and stop bar arrangement.

6. A roller assembly in accordance with claim 2, further comprising a flow control mechanism adapted and constructed to compensate for localized tubing collapse at the rotor stop position.

7. A roller assembly in accordance with claim 1, wherein the rotor control mechanism comprises a slip clutch on which the rollers are mounted.

8. In a pump having a rotary portion which compels the movement of a fluid by peristaltic compression of resilient tubing containing the fluid, a roller assembly comprising the following:

a rotor having a pair of rollers mounted at circumferentially spaced-apart positions in the rotary portion of the pump for contact with the resilient tubing, the rollers having a range of rotation in contact with the tubing during pump operation; and a rotor control mechanism adapted and constructed to stop the rotor so that one of the rollers of the pair of rollers is stopped at a single, predetermined location on the tubing when the pump operation is stopped.

9. A roller assembly in accordance with claim 8, wherein the rollers are mounted 180° from one another.

10. A roller assembly in accordance with claim 9, further comprising a pump occlusion spaced from the rollers such that the rollers trap a consistent quantity of fluid between them during operation of the pump.

11. A roller assembly in accordance with claim 9, wherein the rotor control mechanism is adapted and constructed to cause one of the rollers to stop at a bottom position thereof.

12. A roller assembly in accordance with claim 11, wherein the rotor control mechanism comprises a stop-pin and stop bar arrangement.

13. A roller assembly in accordance with claim 9, further comprising a flow control mechanism adapted and constructed to compensate for localized tubing collapse at the roller stop position.

14. A roller assembly in accordance with claim 8, wherein the rotor control mechanism comprises a slip clutch on which the rollers are mounted.

15. A method for operating a pump having a rotary portion which compels the movement of a fluid by peristaltic compression of resilient tubing containing the fluid comprising the following:

mounting a rotor having at least one roller in the rotary portion of the pump for contact with the resilient tubing, the at least one roller having a range of rotation in contact with the tubing during pump operation;

operating the pump by rotating the rotor; and stopping the rotor by using a rotor control mechanism to stop the rotor so that the at least one roller is stopped at a single, predetermined location on the tubing when the pump operation is stopped.

16. A method in accordance with claim 15, wherein mounting comprises mounting a rotor having two rollers.

17. A method in accordance with claim 16, wherein mounting comprises mounting the rotor so that the rollers are spaced apart circumferentially, thereby trapping a consistent quantity of fluid between the rollers during operation of the pump.

18. A method in accordance with claim 16, wherein stopping comprises using the rotor control mechanism to stop the rotor so one of the rollers is stopped at a bottom position thereof.

19. A method in accordance with claim 16, further comprising compensating for localized tubing collapse at the roller stop position via a flow control mechanism.

20. A method in accordance with claim 15, further comprising mounting the rollers on a slip clutch.

* * * * *

UNITED STATES PATENT AND TRADEMARK OFFICE

CERTIFICATE OF CORRECTION

PATENT NO. : 7,140,850 B2
APPLICATION NO. : 10/627459
DATED : November 28, 2006
INVENTOR(S) : David R. Otis, Jr.

It is certified that error appears in the above-identified patent and that said Letters Patent is hereby corrected as shown below:

In column 4, line 45, in Claim 7, delete “rollers” and insert -- rotors --, therefor.

In column 5, line 10, in Claim 14, delete “rollers” and insert -- rotors --, therefor.

Signed and Sealed this

Thirtieth Day of December, 2008

JON W. DUDAS
*Director of the United States Patent and Trademark Office*